US011986026B2

(12) United States Patent
Wachmann

(10) Patent No.: US 11,986,026 B2
(45) Date of Patent: May 21, 2024

(54) UNITARY BABY BIB

(71) Applicant: Batya Wachmann, Elad (IL)

(72) Inventor: Batya Wachmann, Elad (IL)

( * ) Notice: Subject to any disclaimer, the term of this patent is extended or adjusted under 35 U.S.C. 154(b) by 0 days.

(21) Appl. No.: 17/955,861

(22) Filed: Sep. 29, 2022

(65) Prior Publication Data

US 2023/0095605 A1 Mar. 30, 2023

(30) Foreign Application Priority Data

Sep. 30, 2021 (IL) ..... 286884

(51) Int. Cl.
*A41B 13/10* (2006.01)

(52) U.S. Cl.
CPC ..... *A41B 13/10* (2013.01)

(58) Field of Classification Search
CPC ..... A41B 13/10; A41B 13/005; A41D 13/04
See application file for complete search history.

(56) References Cited

U.S. PATENT DOCUMENTS 712,908 A * 11/1902 Clark ..... A41D 13/04 2/51
742,059 A * 10/1903 Peterson ..... A41B 13/10 2/51
1,153,909 A * 9/1915 Hanes ..... A41D 13/04 2/48
1,424,013 A * 7/1922 Hale ..... A41D 13/04 2/48
1,451,095 A * 4/1923 Greene ..... A41D 13/04 2/51
1,478,349 A * 12/1923 Oberndorfer ..... A41D 13/04 2/51
2,129,486 A * 9/1938 Berman ..... A41D 13/046 24/546
2,132,466 A * 10/1938 Goldberg ..... A41D 13/04 2/48
2,169,759 A * 8/1939 Cleveland ..... A41D 13/04 2/76
2,490,477 A * 12/1949 Runck ..... A41D 13/04 2/52
2,507,382 A * 5/1950 Norvich ..... A41D 11/00 D2/743
2,563,161 A * 8/1951 Dixon ..... A41B 13/005 D2/713
2,735,102 A * 2/1956 Plattner ..... A41B 13/00 2/80
3,085,248 A * 4/1963 Benson ..... A41B 13/00 2/46
4,823,405 A * 4/1989 Porter ..... B60N 2/2839 2/80
5,095,544 A * 3/1992 Elverskog ..... A41D 13/0543 2/2.5

(Continued)

*Primary Examiner* — Jillian K Pierorazio
(74) *Attorney, Agent, or Firm* — Rivka Friedman

(57) ABSTRACT

A garment for partially covering a baby, the garment including: a unitary front panel including shoulder flaps, a contoured neckline, and a bifurcated lower section, the front panel adapted to cover over at least part of upper and lower portions of an anterior surface of the baby's body when worn thereon; and stretchable retention bands coupling at least each of the shoulder flaps to a torso area of the front panel on a side opposite the respective shoulder flap such that at least two bands form a crisscross pattern behind the front panel.

14 Claims, 6 Drawing Sheets

(56) References Cited

U.S. PATENT DOCUMENTS

| | | | | |
|---|---|---|---|---|
| 6,338,164 | B1 * | 1/2002 | Howard | A41D 13/06 2/242 |
| 6,839,917 | B1 * | 1/2005 | Landwehr | A41D 13/04 2/22 |
| 9,226,532 | B2 * | 1/2016 | Orozco | A41D 11/00 |
| 2005/0257309 | A1 * | 11/2005 | Knoefel | A41D 13/04 2/114 |
| 2006/0107435 | A1 * | 5/2006 | Westcott | A41D 17/02 2/69 |
| 2009/0031466 | A1 * | 2/2009 | Grimes | A41D 13/065 2/22 |
| 2009/0070910 | A1 * | 3/2009 | McNally | A41D 13/04 2/46 |
| 2012/0042430 | A1 * | 2/2012 | McConaghy | A41D 1/215 2/46 |
| 2014/0059732 | A1 * | 3/2014 | Hennessey | A41B 13/10 2/49.1 |
| 2017/0086515 | A1 * | 3/2017 | Ruiz | A41D 13/0575 |
| 2017/0295854 | A1 * | 10/2017 | Gevirtz | A41F 15/002 |
| 2019/0289924 | A1 * | 9/2019 | Gordon | A41B 13/10 |

* cited by examiner

UNITARY BABY BIB

This patent application claims priority from, and the benefit of, Israel Patent Application No. 286884 filed Sep. 30, 2021, which is incorporated in its entirety as if fully set forth herein.

FIELD OF THE INVENTION

The present invention relates to a baby accessory and, more particularly, to a full-frontal bib in which a baby can crawl.

BACKGROUND OF THE INVENTION

The Problem

A baby in the crawling stage rubs against the floor repeatedly and, while this is an important part of the child's development, is also a problem:

1. Friction against the floor makes the baby's clothes very dirty, sometimes irreversibly.
2. Contact with the floor when the baby is without pants or in shorts may be cold and/or painful.
3. A baby at this stage of development may regurgitate often and can very easily get dirty and wet crawling in the regurgitated material.

These problems bother mothers every day and cause them to:

Avoid letting the babies crawl around before going to kindergarten, etc., lest they dirty their clean clothes.

Avoid dressing the baby in the nice clothes except when not crawling.

Avoid dressing the baby in summer/short clothes in the summer for fear of getting the chills and/or experiencing unpleasant friction.

Avoid constantly changing the child's dirty and/or wet clothing

SUMMARY OF THE INVENTION

There is provided a crawling apron that covers the front part of the baby's body and prevents direct contact between the baby's knees and the floor.

The bib was developed with great thought and in exact accordance with the needs of the crawling baby, having features including:

airy and breathable material that covers only the parts that may touch the floor;

impermeable to liquids;

flexible and comfortable for the baby in all positions: crawling, bending, twisting, sleeping, and sitting.

easy to put on.

washable.

100% clean happy baby.

According to the present invention there is provided a garment for partially covering a baby, the garment including: a unitary front panel including shoulder flaps, a contoured neckline, and a bifurcated lower section, the front panel adapted to cover over at least part of upper and lower portions of an anterior surface of the baby's body when worn thereon; and stretchable retention bands coupling at least each of the shoulder flaps to a torso area of the front panel on a side opposite the respective shoulder flap such that at least two bands form a crisscross pattern behind the front panel.

According to further features in preferred embodiments of the invention described below the stretchable retention straps include two thigh straps each sewn at an edge of a respective side of a waist area of the front panel to an edge of a crotch area of the front panel.

According to still further features the stretchable retention straps include two ankle straps each coupled from a respective first edge of a first side of an ankle area of the bifurcated lower section to a respective second edge of a second side thereof.

According to still further features the stretchable retention straps include two knee straps each sewn at a first respective edge of a first side of a knee area of the bifurcated lower section and at a second respective edge of a second side thereof.

According to still further features the front panel is comprised of a single layer of absorbent material. According to still further features the front panel is comprised of two layers including an outer layer including absorbent material and an inner layer including waterproof or water-resistant material. According to still further features the front panel is comprised of three layers including an outer layer made of absorbent material, an intermediate layer made of waterproof or water-resistant material, and an inner layer of clothing fabric.

According to still further features the outer and intermediate layers are formed on respective sides of a shared substrate. According to still further features the inner and intermediate layers are formed on respective sides of a shared substrate. According to still further features the outer and inner layers are formed on respective sides of a shared substrate.

According to still further features the front panel is sleeveless. According to still further features the front panel includes partial or full sleeves.

According to another embodiment, there is provided a garment for partially covering a baby, the garment including: a unitary front panel including shoulder flaps, a contoured neckline, and a torso section, the front panel adapted to cover over at least part of an upper portion of an anterior surface of the baby's body when worn thereon; and stretchable retention bands coupling at least each of the shoulder flaps to the torso area of the front panel on a side opposite the respective shoulder flap such that at least two bands form a crisscross pattern behind the front panel.

According to further features the front panel is comprised of two layers including an outer layer including absorbent material and an inner layer including waterproof or water-resistant material. According to further features the front panel is comprised of three layers including an outer layer made of absorbent material, an intermediate layer made of waterproof or water-resistant material, and an inner layer of clothing fabric.

BRIEF DESCRIPTION OF THE DRAWINGS

Various embodiments are herein described, by way of example only, with reference to the accompanying drawings, wherein.

DESCRIPTION OF THE PREFERRED EMBODIMENTS

The principles and operation of a protective crawling garment (bib or apron) for partially covering a baby's body according to the present invention may be better understood with reference to the drawings and the accompanying description.

There is disclosed a crawling bib/apron for a baby that functions as a regular eating bib as well as to prevent getting the skin or clothes dirty, painful friction of bare skin even on smooth ground, getting scraped or cut when on uneven/outdoor surfaces and/or unwanted cooling (e.g., leading the child to catch a cold) of the baby from the floor while crawling. The bib covers the front part of the crawling baby's body, including the chest, stomach, and legs. Children can be left to eat on their own more, as the crawling bib protects the body and clothing, including pants/legs, from getting dirtied by the food etc.

The cut of the article of clothing is in the form/shape of an apron, but extending like pants for the legs, in order to cover the body in the front only. The apron is closed at the back with elastic material (straps or bands) sewn from side to side by the legs and crisscrossed over the back.

The material used in different embodiments:

In all embodiments, the elastic/stretchable material is soft and flexible.

Apron A: made of a single absorbent and flexible layer of material.

Apron B: made of two layers of material, an outer layer that is absorbent and flexible and an inner layer that is waterproof. The outer layer picks up dirt and grime while the inner layer prevents liquids from permeating the apron and wetting the baby.

Apron C: including three layers of material: an outer layer that is absorbent and flexible with a waterproof backing. The inner layer is any clothing material (e.g., cotton etc.). The outer layer absorbs the dirt and fluids while the waterproof backing prevents any fluids from permeating the outer layer. The inner layer of material is for added comfort for the baby, as waterproof backing/layer can be uncomfortable when in contact with skin.

Use—the Way of Wearing and Fastening the Apron/Bib:

The free ends of the apron that go around to the back of the baby are closed from side to side with elastic/stretchable bands of material sewn to the edges of the bib. The apron is worn when it is closed and placed on the baby by threading the apron over the head and hands and placing the legs inside the stretchable bands.

Figure 1A:
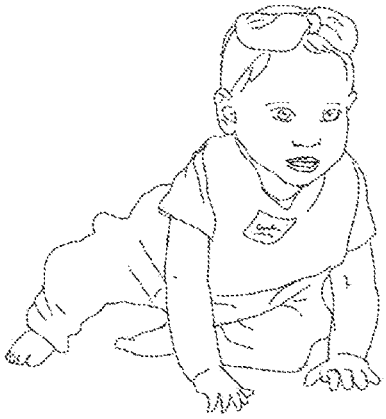
FIGS. 1A and 1B are front and back views of a baby wearing a one-piece, bifurcated garment covering the upper and lower body.
Figure 1B:
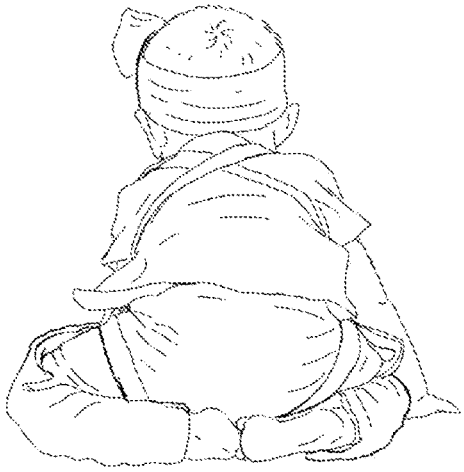

Referring now to the drawings, FIGS. 1A and 1B respectively illustrate front and back views of a baby wearing a one-piece, bifurcated garment covering the upper and lower body. The garment or overall (also referred to hereafter as "apron" or "bib") covers the front of the child but is mainly open at the back except for stretchable retention bands.

The terms "elastic bands [including fabric material]", "stretchable retention bands", "elastic straps", and similar terms are used interchangeably herein to refer to flexible/stretchy material that is able to resume its normal shape spontaneously after dilatation, contraction, or distortion.

The term "unitary" is used herein with regards to the front panel of one or more layers of material to denote that even with multiple layers the panel forms a single or uniform entity.

Figure 2:
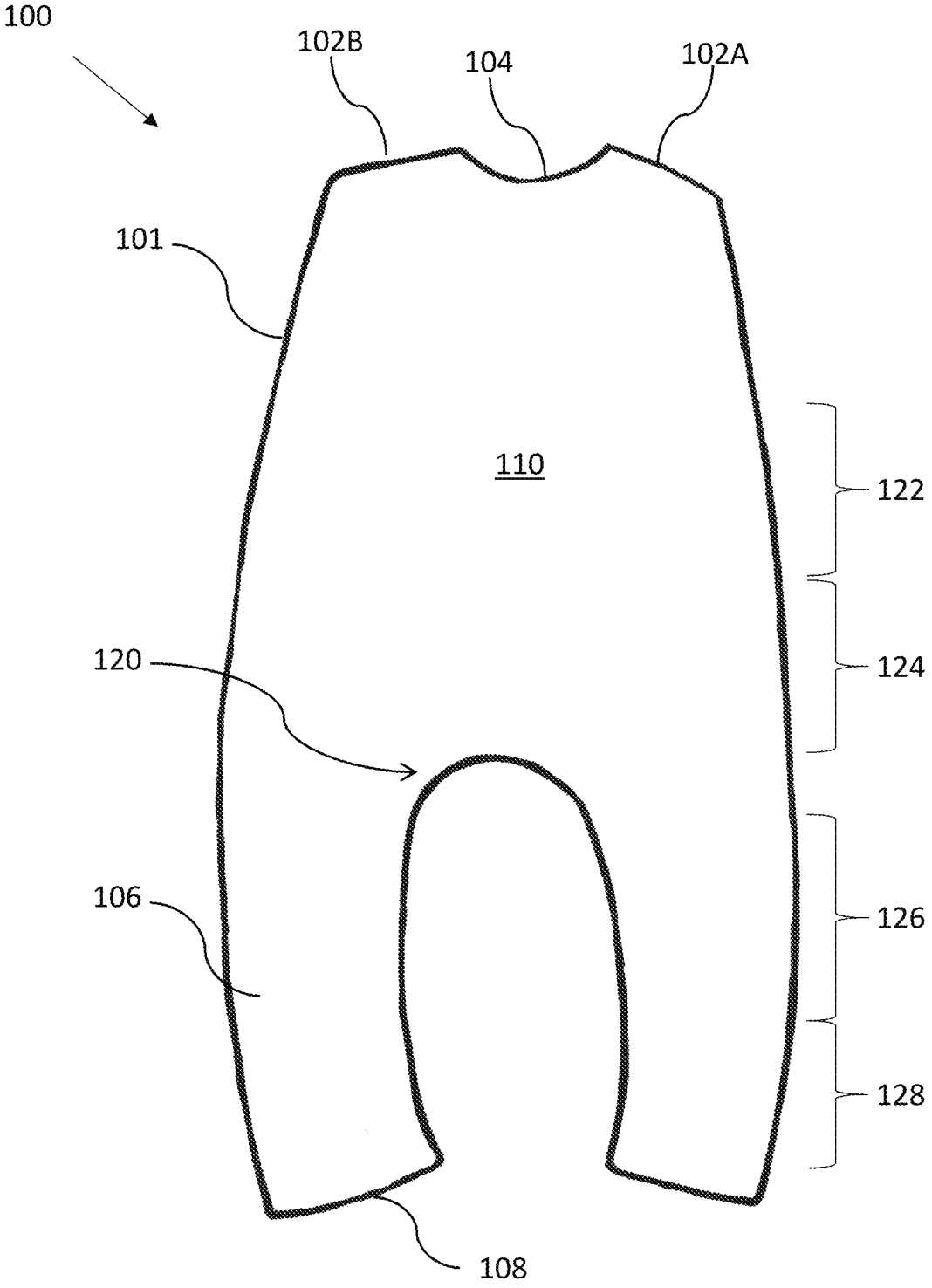
FIG. 2 is a front view of an apron 100.

FIG. 2 is a front view of an apron 100. Apron 100 includes a unitary front panel 101 including shoulder flaps 102A and 102B, a contoured neckline 104, and a bifurcated lower section 106. The front panel 101 is adapted to cover over at least part of upper and lower portions of an anterior surface of the baby's body, from neck to ankles, when worn thereon. The instant apron is a sleeveless garment. The garment is a single piece that is formed of one, two or three layers, as will be discussed below. In some embodiments, the garment includes sleeves (not shown). Such sleeves may be full sleeves, i.e., completely encircle the arms, or, alternatively, may be partial sleeves, i.e., open in the back (posterior) but joined by stretchable bands. In either case the length of the sleeves may be long or short.

The apron 100 has shoulder flaps 102A and 102B that go over the baby's shoulders. There is a contoured neckline 104, contoured to protect any clothing worn beneath the apron like a regular eating bib or baby bib (e.g., to catch regurgitated food or fluids), while being comfortable and not pressing against the windpipe etc. The garment is bifurcated from a crotch area 120 into two leg sections 106 which are adapted to cover each leg individually. The garment 100 terminates at edges 108, not being adapted to cover the feet. In some embodiments (not shown) the garment terminates in booties which are sewn or formed as part of the garment. In other embodiments (not shown) booties can be attached to the ends of leg pieces 108 (e.g., via hook-and-loop fasteners).

The front panel 101, for the purposes of this disclosure, can be seen as having distinct areas or at least different areas whose borders may slightly overlap. The areas are named for the approximate location of the anatomical part of a child wearing the apron 100. Crotch area 120 has already been indicated. A waist area 124 approximates which part of the garment is adapted to cover the waist of the child. A knee area 126 approximates the portion of the garment adapted to cover the knees of the child on each side of the bifurcation (i.e., on each leg of the garment). An ankle area 128 approximates the portion of the garment adapted to cover the ankles of the child on each leg.

The front surface 110 of the apron 100 is, for example, made from an absorbent material. The absorbent material may be microfiber or some other absorbent material that is machine washable (see below for further details of the layers of the front panel 101 with reference to FIGS. 4A-C).

Figure 3:
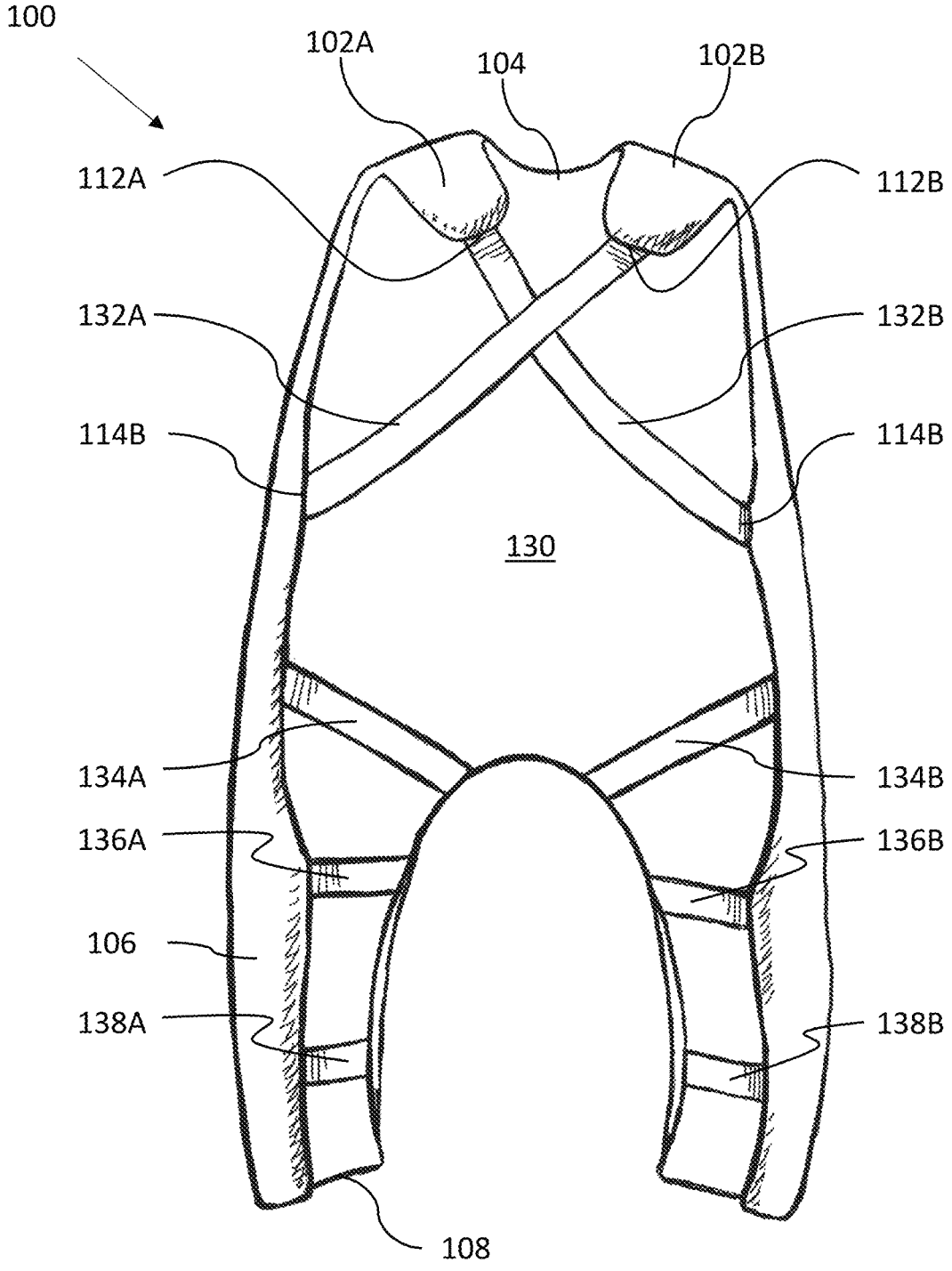
FIG. 3 is a back view of apron 100.

FIG. 3 is a back view of apron 100. The material edges of the front panel 101 that wrap around the torso and legs of the child are coupled together by a series of bands sewn to edges of the front panel. Notably, stretchable retention bands couple at least each of the shoulder flaps to a torso area 122 of the front panel 101 on a side opposite the respective shoulder flap such that at least two bands form a crisscross pattern behind the front panel. Two upper bands 132A and 132B attach the shoulder flaps to the edges of the torso section of the garment. These bands cross each other making an 'X' pattern. Band 132B is sewn to shoulder flap 102A at edge 112A and to the torso section diagonally across at edge 114B. Mirroring band 132B is band 132A which is sewn at shoulder flap 102B at edge 112B to torso section edge 114A. The child's arms fit between the shoulder and torso strap attachments, with the straps crossing the child's back, as can be seen in FIG. 1B.

It is made clear, with regards to the aforementioned and depicted placement of the bands as well as those of the bands that will be discussed hereafter, that the precise placement and/or number of bands, while being preferred, is not to be construed as being limited to these locations or configurations.

Bands 134A and 134B each stretch from approximately a waist area 124 to the crotch area of the garment. The two thigh straps 134A/B are each sewn at an edge of a respective side of a waist area of the front panel 101 to an edge of a crotch area 120 of the front panel 101. The straps are adapted to cross the upper thighs of the child. These thigh straps prevent the material from pulling up while crawling, and keep the material close to the body, allowing unencumbered crawling.

Bands 136A and 138A are adapted to receive one of the child's legs therein (e.g., a left leg) and bands or straps 136B and 138B are adapted to receive the child's other leg therein (e.g., the right leg). The set of stretchable retention straps includes two knee straps 136A/B which are each sewn at one end to a first respective edge of a first side of the knee area 126 of the bifurcated lower section and at the other end are sewn to a second respective second edge of the second side of the respective leg section of the bifurcated lower section. Bands 136A and 136B near the child's knee keep the material tightly pulled against the clothing or skin.

The set stretchable retention straps include two ankle straps 138A/B, each of which is coupled from a respective first edge of a first side of an ankle area of the bifurcated lower section to a respective second edge of a second side thereof. Bands 138A and 138B are located near the ankles prevent the material from riding up while crawling. Together, the legs straps keep the material close to the clothing or body, allowing the baby to roam around easily.

The width of the bands, while not being specifically prescribed, can be visibly judged as functioning to ensure that the apron stays in place and performs the function of keeping the child or the child's clothes clean and protecting the child from undesirable friction. On the other hand, the bands are not so wide as to obscure the clothing underneath (as seen from the back) and/or make the child hot, sweaty, and uncomfortable (e.g., in a hot environment).

In embodiments, the bands are made of stretchy, elastic material that is both comfortable to the touch as well as sufficiently taut to ensure that the outer layer of absorbent material is held against the underneath clothing or child's body. This allows the child to crawl around in an unencumbered manner. As such, the outer layer not only covers the anterior side of the child but also curves around the various body parts (in some cases more so and in other cases less so, as evident in the Figures, for example) to a lesser or greater degree.

Inner layer or surface 130 of the garment lies against the clothing underneath the apron and/or the baby's skin. Three embodiments of the layers of material that make up the front panel 101 of the apron garment 100 are discussed hereafter. According to each embodiment, the inner layer may either be: (1) the same layer (and hence the same material) as the outer layer, (2) a waterproof layer backing the outer layer, or (3) a cloth layer that is distinct from the outer layer and may be of the same or different material.

Figure 4A:
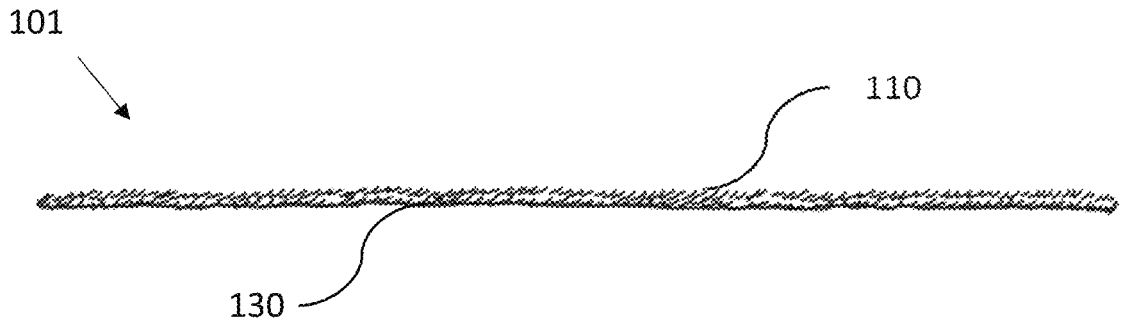
FIG. 4A is a schematic diagram indicative of a first embodiment whereby the front panel of the apron (i.e., the cloth or material part of the apron, excluding the straps) includes a single layer of material.
Figure 4B:
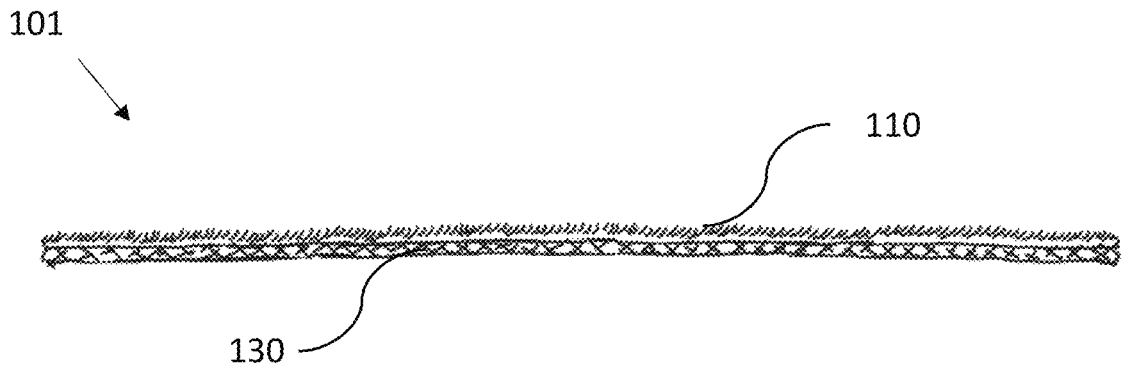
FIG. 4B is a schematic diagram indicative of a second embodiment whereby the front panel 101 of the apron has two layers: a front layer and a back layer.
Figure 4C:
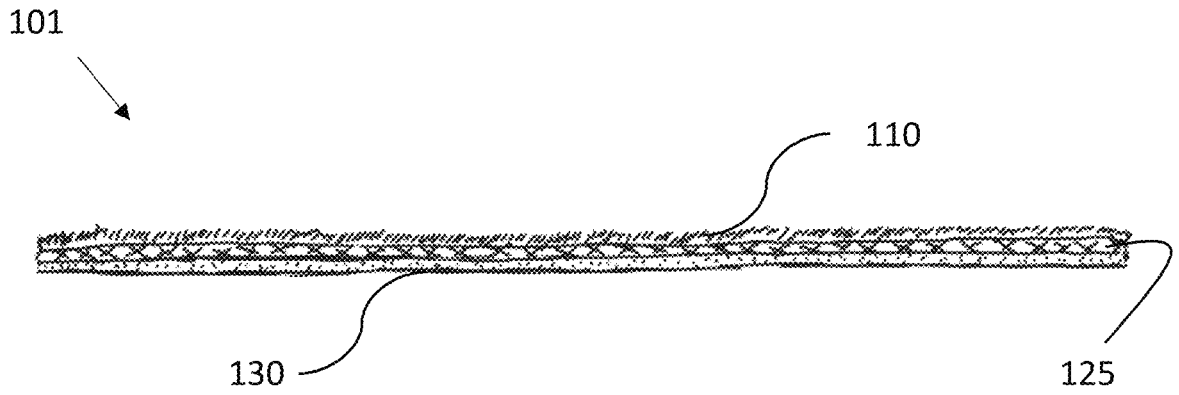
FIG. 4C is a schematic diagram indicative of a third embodiment whereby the front panel of the apron is made up of three layers.

FIGS. 4A, 4B and 4C are schematic diagrams of different embodiments of the body of the apron. For the purposes of clarity, the terms 'front panel', 'body part' or 'body section' or simply 'body' of the apron, as used herein, refers to the material/fabric part of the apron that covers the front of the child, excluding the straps or bands.

FIG. 4A is a schematic diagram indicative of a first embodiment whereby the front panel of the apron (i.e., the cloth or material part of the apron, excluding the straps) includes a single layer of material. According to this embodiment, outer surface 110 and inner surface 130 are two sides of the same layer of material. This material, in embodiments, is a highly absorbent material such as microfiber. In some embodiments a rib knit microfiber is used. In other embodiments, the front panel of the apron is constructed of a material selected from one or more of: acrylic, cotton, flannel, linen, polyester, terrycloth, and wool. However, it will be readily apparent to those ordinarily skilled in the art that any other suitable material can be used to construct the front panel of the apron.

FIG. 4B is a schematic diagram indicative of a second embodiment whereby the front panel 101 of the apron has two layers: a front layer and a back layer. According to this embodiment, outer surface 110 is made of the front layer and inner surface 130 is made of the second layer. In embodiments, the outer or front layer is as described above for the first embodiment. In embodiments, the inner or back layer is made of a waterproof or water-resistant material. The waterproof or water-resistant layer serves as a backing to the outer layer and prevents fluids from permeating the apron front section and dirtying the clothes underneath the apron or the child. For example, the waterproof layer may be made of a polyurethane waterproof material, or another material treated with a durable water repellant. In some embodiments, the inner surface is treated with a durable water repellant so that the outer surface is absorbent while the inner surface is non-permeable (to a greater or lesser degree). In embodiments, the two distinct layers of material may be adhered together, e.g., with an adhesive (may be considered its own layer), via a heating means, and/or being sewn together. In some embodiments, the outer and inner layers are formed on respective sides of a shared substrate. For the purposes of the instant disclosure, the waterproof/water-resistant surface is considered a separate layer.

FIG. 4C is a schematic diagram indicative of a third embodiment whereby the front panel of the apron is made up of three layers. An outer layer, an intermediate layer, and an inner layer. According to this embodiment, outer surface 110 is the outer layer, the intermediate layer 125 is not shown in FIGS. 2 and 3 (however, see FIG. 5) and the inner surface 130 is the inner layer. The outer layer is comprised of absorbent material, such as detailed above with regards to the first embodiment. The intermediate layer is a waterproof or water-resistant layer (as described above with regards to the second embodiment) that serves as a backing to the outer layer and prevents fluids from permeating the apron front section and dirtying the clothes underneath the apron or the child. The third, inner layer is a clothing or garment layer that is adapted to come into contact with at least part of the child's body. The clothing layer is made up of comfortable material that will feel nice to the skin's touch. Like the outer layer, the third, inner layer according to the instant embodiment may be made from one or more materials selected from: acrylic, cotton, flannel, linen, polyester, terrycloth, and wool. However, it will be readily apparent to those ordinarily skilled in the art that any other suitable material can be used to construct the front panel of the apron. Indeed, in some embodiments, the outer and inner layers may be made from the same materials, with a waterproof layer disposed there-between. The layers may be coupled or adhered together in any fashion, for example, via an adhesive (each application of adhesive may be considered a separate layer), via heating, via sewing, and/or any other means known in the art.

In example embodiments, the outer and intermediate layers are formed on respective sides of a shared substrate and adhered to the inner layer using any means detailed heretofore. In example embodiments, the inner and intermediate layers are formed on respective sides of a shared substrate and adhered to the outer layer using any means detailed heretofore.

Figure 5:
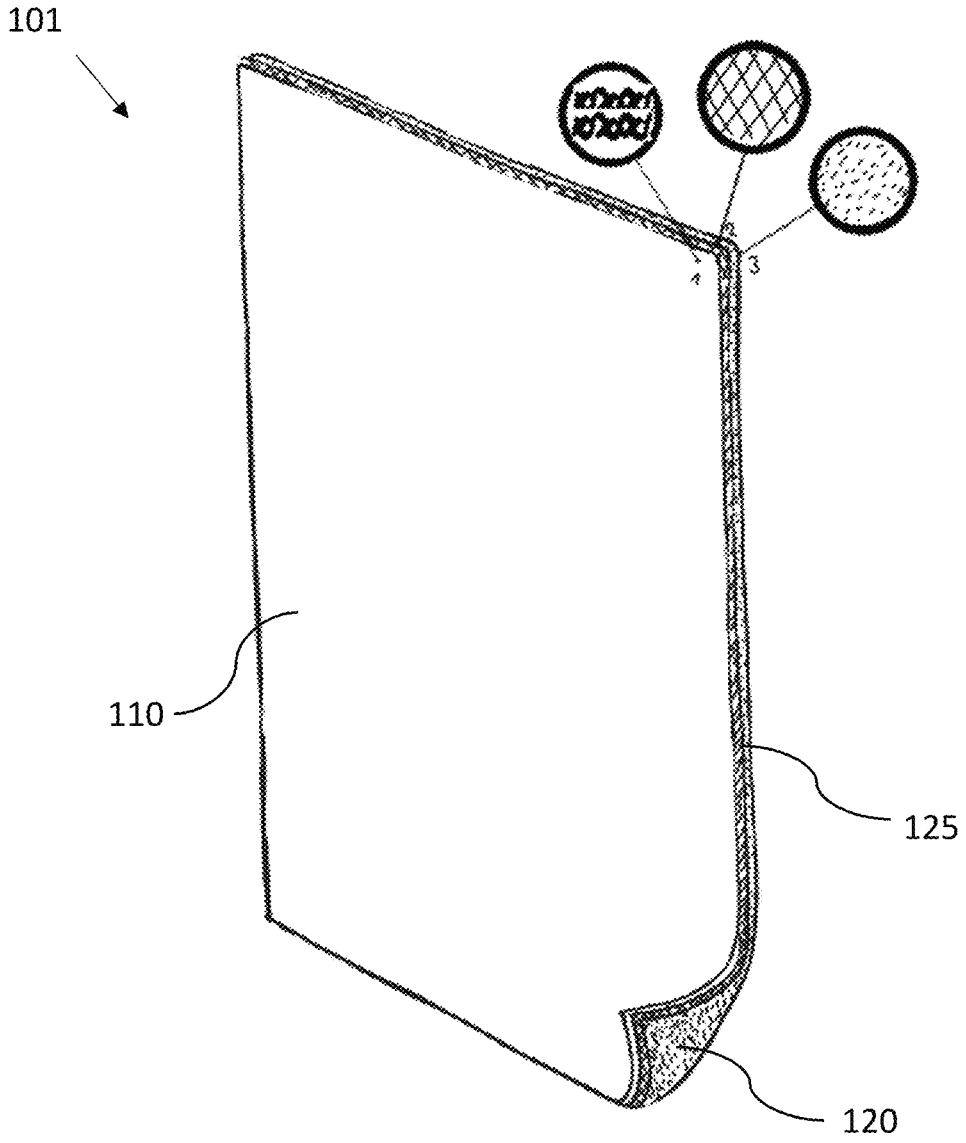
FIG. 5 is an example of the third embodiment described in relation to FIG. 4C.

FIG. 5 depicts an example of the third embodiment described heretofore in relation to FIG. 4C. The piece of cloth is depicted with an outer layer of absorbent material 110 an intermediate waterproof/water-resistant layer 125, and an inner layer of garment material 130.

The presently described apron is a single-piece outfit that can fit over the body of a child at the crawling stage of development, whether the child is wearing clothing or simply has a diaper on. The term 'single-piece outfit' and similar phrases used herein are intended to convey that the outfit covers both the top and bottom parts of the child (with a single piece of material, albeit made up of one or more layers) and that all the pieces and parts of the apron are attached (e.g., by sewing) in a permanent way. This comes to exclude buttons, press-studs, zippers, hook-and-loop fasteners, and any other types of fasteners. The straps (132A/B, 134A/B, 136A/B, 138A/B) are permanently attached to the front panel/garment part of the apron. This structure is for the comfort and safety of the child. For example, it can be painful for a child to crawl, roll onto, or lie on a button or zipper head. Furthermore, buttons tend to come loose and/or can be pried off the clothing and become a choking hazard. All types of fasteners get worn over time, as opposed to sewing which is more durable (there is no repeated opening and closing of the fastener). With sewn straps/bands, it is more difficult for the child to take the apron off by themselves.

In addition, the shoulder flaps 102A and 102B do not encircle the neck and are not cinched behind the next. Rather each shoulder flap is connected to the opposite torso area of the apron by a band. This configuration avoids the situation whereby the bib pulls on the baby's neck when the child is crawling and pins the bib with a knee while moving their head forward, thereby causing the section of the bib or tying ribbon to pull on the back on the neck.

Figure 6A:
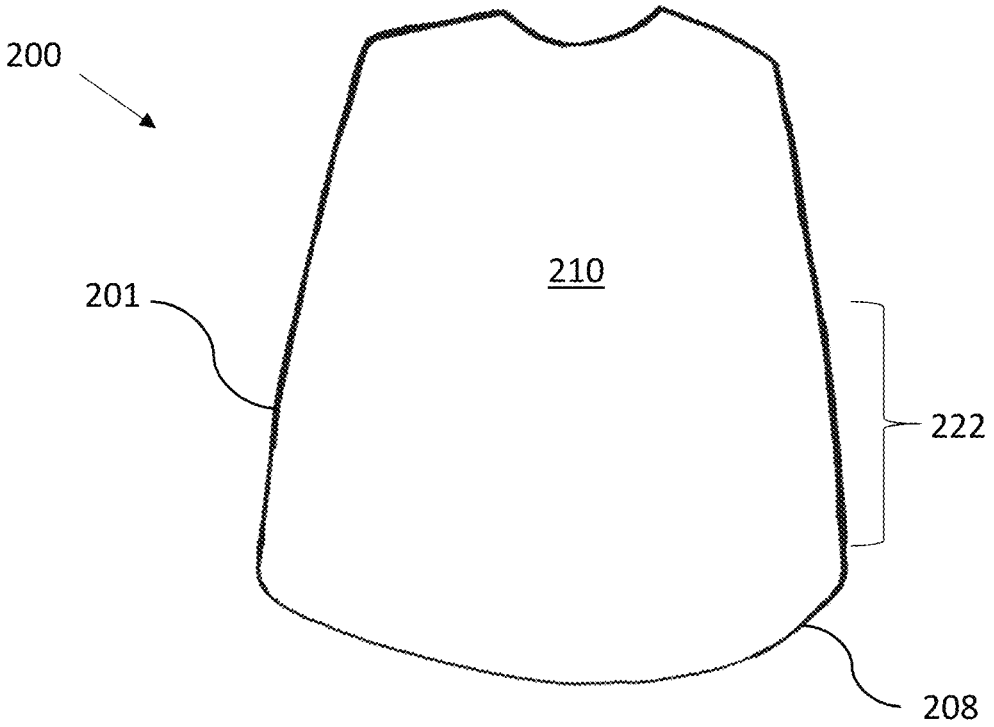
FIGS. 6A and 6B are front and back views respectively of a second configuration of the bib/apron.
Figure 6B:
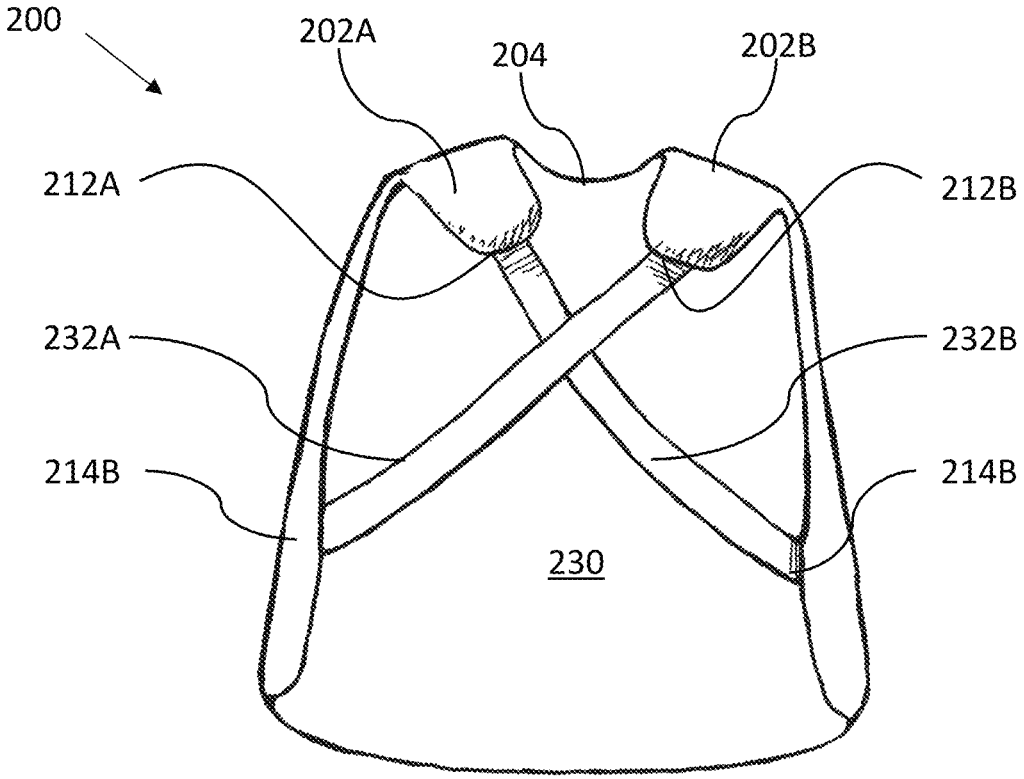

Another configuration is shown in FIGS. 6A and 6B. FIGS. 6A and 6B are front and back views respectively of a second configuration of the bib/apron. FIG. 6A is a front view of a bib 200. Bib Apron 200 includes a unitary front panel 201 including shoulder flaps 202A and 202B, a contoured neckline 204. The front panel 201 is adapted to cover over at least part of upper portions of an anterior surface of the baby's body, from neck to waist, when worn thereon. The instant apron is a sleeveless garment. The garment is a single piece that is formed of one, two or three layers as detailed above and is applicable here, mutatis mutandis, as if fully set forth here. In some embodiments, the garment includes sleeves (not shown). Such sleeves may be full sleeves, i.e., completely encircle the arms, or, alternatively, may be partial sleeves, i.e., open in the back (posterior) but joined by stretchable bands. In either case the length of the sleeves may be long or short.

The apron 200 has shoulder flaps 202A and 202B that go over the baby's shoulders. There is a contoured neckline 204, contoured to protect any clothing worn beneath the apron like a regular eating bib or baby bib (e.g., to catch regurgitated food or fluids), while being comfortable and not pressing against the windpipe etc. The garment 200 terminates at edge 208, not being adapted to cover the lower part of the body. In other embodiments (not shown) a lower apron piece (similar that that which is described above from the crotch area to the distal edge of the garment 100) can be attached to the edge 208 (e.g., via hook-and-loop fasteners and the like).

FIG. 6B is a back view of apron 200. The material edges of the front panel 201 that wrap around the torso and legs of the child are coupled together by a series of bands sewn to edges of the front panel. Notably, stretchable retention bands couple at least each of the shoulder flaps to a torso area 222 of the front panel 201 on a side opposite the respective shoulder flap such that at least two bands form a crisscross pattern behind the front panel. Two upper bands 232A and 232B attach the shoulder flaps to the edges of the torso section of the garment. These bands cross each other making an 'X' pattern. Band 232B is sewn to shoulder flap 202A at edge 212A and to the torso section diagonally across at edge 214B. Mirroring band 232B is band 232A which is sewn at shoulder flap 202B at edge 212B to torso section edge 214A. The child's arms fit between the shoulder and torso strap attachments, with the straps crossing the child's back.

It is made clear, with regards to the aforementioned and depicted placement of the bands as well as those of the bands that will be discussed hereafter, that the precise placement and/or number of bands, while being preferred, is not to be construed as being limited to these locations or configurations.

In embodiments, the bands are made of stretchy, elastic material that is both comfortable to the touch as well as sufficiently taut to ensure that the outer layer of absorbent material is held against the underneath clothing or child's body. This allows the child to crawl around in an unencumbered manner. As such, the outer layer not only covers the anterior side of the child but also curves around the various body parts (in some cases more so and in other cases less so, as evident in the Figures, for example) to a lesser or greater degree.

Inner layer or surface 230 of the garment lies against the clothing underneath the apron and/or the baby's skin. Three embodiments of the layers of material that make up the front panel 201 of the apron garment 200 are discussed hereafter. According to each embodiment, the inner layer may either be: (1) the same layer (and hence the same material) as the outer layer, (2) a waterproof layer backing the outer layer, or (3) a cloth layer that is distinct from the outer layer and may be of the same or different material. According to a first embodiment whereby the front panel 201 (i.e., the cloth or material part of the apron, excluding the straps) of the apron 200 includes a single layer of material. According to this embodiment, outer surface 210 and inner surface 230 are two sides of the same layer of material. This material, in embodiments, is a highly absorbent material such as microfiber. In some embodiments a rib knit microfiber is used. In other embodiments, the front panel of the apron is constructed of a material selected from one or more of: acrylic, cotton, flannel, linen, polyester, terrycloth, and wool. However, it will be readily apparent to those ordinarily skilled in the art that any other suitable material can be used to construct the front panel of the apron.

According to a second embodiment, the front panel is comprised of two layers including an outer layer (e.g., outer surface 210) including absorbent material and an inner layer (e.g., inner surface 230) including waterproof or water-resistant material.

According to a third embodiment, the front panel is comprised of three layers including an outer layer (e.g., outer surface 210) made of absorbent material, an intermediate layer (not shown but similar to layer 125 described above) made of waterproof or water-resistant material, and an inner layer (e.g., inner surface 230) of clothing fabric.

The aforementioned discussion regarding the various configurations of the layers according to the aforementioned embodiments is similar, mutatis mutandis, to that of apron 100 and should be seen as if fully set forth here.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A garment for partially covering a baby, the garment comprising:

a unitary front panel including shoulder flaps, a contoured neckline, and a bifurcated lower section, the front panel adapted to cover over at least part of upper and lower portions of an anterior surface of the baby's body when worn thereon; and stretchable retention bands coupling at least each of the shoulder flaps to a torso area of the front panel on a side opposite the respective shoulder flap, the stretchable retention bands including at least two bands that form a crisscross pattern behind the front panel wherein each of the at least two bands is sewn at a shoulder flap and at an edge of the torso area diagonally opposite the shoulder flap.

2. The garment of claim 1, wherein the stretchable retention straps include two thigh straps each sewn at an edge of a respective side of a waist area of the front panel to an edge of a crotch area of the front panel.

3. The garment of claim 1, wherein the stretchable retention straps include two ankle straps each coupled from a respective first edge of a first side of an ankle area of the bifurcated lower section to a respective second edge of a second side thereof.

4. The garment of claim 3, wherein the stretchable retention straps include two knee straps each sewn at a first respective edge of a first side of a knee area of the bifurcated lower section and at a second respective edge of a second side thereof.

5. The garment of claim 1, wherein the front panel is comprised of a single layer of absorbent material.

6. The garment of claim 1, wherein the front panel is comprised of two layers including an outer layer including absorbent material and an inner layer including waterproof or water-resistant material.

7. The garment of claim 6, wherein the outer and inner layers are formed on respective sides of a shared substrate.

8. The garment of claim 1, wherein the front panel is comprised of three layers including an outer layer made of absorbent material, an intermediate layer made of waterproof or water-resistant material, and an inner layer of clothing fabric.

9. The garment of claim 8, wherein the outer and intermediate layers are formed on respective sides of a shared substrate.

10. The garment of claim 8, wherein the inner and intermediate layers are formed on respective sides of a shared substrate.

11. The garment of claim 1, wherein the front panel is sleeveless.

12. A garment for partially covering a baby, the garment comprising:

a unitary front panel including shoulder flaps, a contoured neckline, and a torso section, the front panel adapted to cover over at least part of an upper portion of an anterior surface of the baby's body when worn thereon; and stretchable retention bands coupling at least each of the shoulder flaps to the torso area of the front panel on a side opposite the respective shoulder flap, the stretchable retention bands including at least two bands that form a crisscross pattern behind the front panel wherein each of the at least two bands is sewn at a shoulder flap and at an edge of the torso area diagonally opposite the shoulder flap.

13. The garment of claim 12, wherein the front panel is comprised of two layers including an outer layer including absorbent material and an inner layer including waterproof or water-resistant material.

14. The garment of claim 12, wherein the front panel is comprised of three layers including an outer layer made of absorbent material, an intermediate layer made of waterproof or water-resistant material, and an inner layer of clothing fabric.

* * * * *